US009789417B2

(12) United States Patent
Vandoren

(10) Patent No.: US 9,789,417 B2
(45) Date of Patent: Oct. 17, 2017

(54) CONSTRUCTION TOY

(76) Inventor: Rolf Vandoren, Kontich (BE)

( * ) Notice: Subject to any disclaimer, the term of this patent is extended or adjusted under 35 U.S.C. 154(b) by 39 days.

(21) Appl. No.: 14/003,967

(22) PCT Filed: Feb. 22, 2012

(86) PCT No.: PCT/BE2012/000009
§ 371 (c)(1),
(2), (4) Date: Sep. 9, 2013

(87) PCT Pub. No.: WO2012/116419
PCT Pub. Date: Sep. 7, 2012

(65) Prior Publication Data

US 2014/0094083 A1 Apr. 3, 2014

(30) Foreign Application Priority Data

Feb. 28, 2011 (BE) ..... 2011/0142

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/26; A63H 33/046; A63H 33/062; A63H 33/105; A63H 33/101
USPC ..... 446/85, 129, 137, 92, 122
See application file for complete search history.

(56) References Cited

U.S. PATENT DOCUMENTS 3,458,949 A * 8/1969 Young ..... 446/124
4,030,209 A * 6/1977 Dreiding ..... 434/278
4,038,775 A * 8/1977 Sato ..... 446/92
4,118,888 A * 10/1978 Ogawa ..... 446/92
4,186,515 A * 2/1980 Ogawa ..... 446/99
D254,752 S * 4/1980 Gabriel ..... D21/486
4,326,354 A * 4/1982 Hagberg ..... 446/126
4,548,590 A * 10/1985 Green ..... 446/120
4,781,644 A * 11/1988 Yoshida ..... 446/123
5,061,219 A * 10/1991 Glickman ..... A63H 33/101 446/120
5,326,301 A * 7/1994 Woodside ..... 446/176
5,704,186 A * 1/1998 Alcalay ..... A63H 33/062 403/188
6,027,391 A * 2/2000 DeRennaux ..... 446/67
6,185,887 B1 * 2/2001 Strassle ..... 52/282.2
(Continued)

FOREIGN PATENT DOCUMENTS

DE 2248688 A1 4/1974
DE 3910304 A1 10/1990
(Continued)

*Primary Examiner* — Aarti B Berdichevsky
*Assistant Examiner* — Urszula M Cegielnik
(74) *Attorney, Agent, or Firm* — John Alumit

(57) ABSTRACT

Construction toy, characterised in that it primarily consists of a set of construction elements of rods (1) with magnetic ends, balls (2) and one or more preformed attachments (15) that can be suitably affixed to the rods (1), and which to this end have a fastening clip (18) with arms (19) of an elastic material that have at least one rib on each of the sides facing one another, whereby the rods have a primarily octagonal cross-section with diagonally opposite sides (8) that are linked together by other diametrically opposite sides (9) that each have a groove (10) in which the aforementioned ribs (21) can snap in place.

12 Claims, 10 Drawing Sheets

(56) References Cited

U.S. PATENT DOCUMENTS 6,450,853 B1 * 9/2002 Larws ..... A63H 33/101 446/122
6,626,727 B2 * 9/2003 Balanchi ..... 446/85
6,669,526 B2 * 12/2003 Manville ..... A63H 33/101 446/100
6,672,931 B1 * 1/2004 Bagley ..... 446/106
6,702,641 B2 * 3/2004 Oakley ..... 446/92
6,846,216 B1 * 1/2005 Balanchi ..... 446/85
6,893,315 B2 * 5/2005 Barri ..... 446/92
6,948,998 B2 * 9/2005 Bagley ..... 446/124
7,223,152 B2 * 5/2007 Anderson ..... 446/487
7,326,100 B2 * 2/2008 O'Brien ..... 446/97
7,371,147 B2 * 5/2008 Tusacciu ..... A63H 33/046 446/122
7,892,065 B2 * 2/2011 Vicentelli ..... 446/92
8,070,551 B1 * 12/2011 Clever ..... 446/124
8,109,803 B2 * 2/2012 Kichijo et al. ..... 446/109
8,317,564 B1 * 11/2012 Buhrman ..... 446/108
2003/0082986 A1 * 5/2003 Wiens ..... A63H 33/062 446/120
2004/0018473 A1 * 1/2004 Tusacciu ..... A63H 33/046 434/73
2004/0043164 A1 * 3/2004 Vicentelli ..... 428/34.1
2005/0124259 A1 * 6/2005 Tusacciu ..... A63H 33/046 446/129
2005/0159074 A1 * 7/2005 Kowalski ..... A63H 33/12 446/102
2006/0014467 A1 * 1/2006 Tusacciu ..... 446/126
2009/0203288 A1 * 8/2009 Aggar ..... A63H 33/12 446/120
2009/0288283 A1 * 11/2009 Fullerton ..... A63H 33/046 29/428

FOREIGN PATENT DOCUMENTS

EP 2022552 A1 2/2009
FR 2153792 A5 5/1973
WO 2009130435 A1 10/2009

* cited by examiner

CONSTRUCTION TOY

The present invention relates to a construction toy, more specifically a toy that contains construction elements that form the building blocks of the toy, and with which the user can devise and build all kinds of constructions.

The purpose of the present invention is to provide an alternative construction toy that is not only fun to play with, but which also presents educational properties and which, due to its simplicity and certain aspects of its form and minimum dimensions, can also be safely used by children under the age of 36 months.

To this end the invention relates to a construction toy that primarily consists of a set of construction elements in the form of a number of rods with magnetic ends, in the form of a number of balls of a material that can interact magnetically with the ends of the rods, and in the form of one or more preformed attachments that can be suitably affixed to the rods, and which to this end have a fastening clip with two primarily parallel arms consisting of sufficiently elastic material that have at least one rib on each of the sides facing one another, whereby the rods have a primarily octagonal cross-section with four diagonally opposite sides that are linked together by four other diametrically opposite sides that each have a groove extending along the longitudinal axis of the rod, in which the aforementioned ribs can snap in place.

Preferably the rods consist of at least two types of rods where both ends have the same polarity, i.e. rods where both ends form an outward-facing magnetic North Pole, and rods where both ends form an outward-facing magnetic South Pole.

With a construction toy according to the invention, the attachments can be affixed to a rod in four different fixed angular positions, each time turned by a quarter turn.

In this way different attachments can be affixed together on a rod in mutually variable positions.

As a result of the possible combinations of different attachments and the possible mutual positions between these attachments, a construction toy is realised that enables a wide variety of possible compositions and constructions with a limited number of components. Of these constructions and compositions, most can be seen as clearly recognisable forms or objects, such as all manner of cars, trailers, trains, trucks, aircraft and similar.

Preferably the arms, on their sides facing one another, of the fastening clip of all possible conceivable attachments have two parallel ribs that are at such a distance from one another that they snap in place in pairs between the longitudinal edges that border an aforementioned groove.

As a result a very stable construction is obtained whereby the attachments are difficult to twist out of their position around the rod, to which they are affixed, while playing with the constructions and compositions made.

On the other hand, an attachment can be slid along the longitudinal axis of the rod without too much difficulty, and this without mutually turning the attachments with respect to one another, and without turning the attachments with respect to the rod on which they are affixed.

According to a preferred embodiment, at one or both ends the grooves widen obliquely towards the outside via an upward slanting edge along the longitudinal axis of the rod.

This provides the advantage that attachments can be released from a rod more easily by sliding the attachment on the rod towards one of the two ends, whereby the upward slanting edges ensure that the arms of the fastening clip, when sliding the attachment, are automatically pushed from one another to open up the clip for removal.

The aforementioned rods and attachments preferably form part of a magnetic construction toy whereby the rods have magnetic ends, and whereby the construction toy also contains a number of balls of the same diameter that are manufactured from a material that can magnetically interact with the magnetic ends of the rods.

According to a preferred characteristic, the rods with a double North Pole and the rods with a double South Pole have a different appearance, such that the differences between the rods with a double North Pole and the rods with a double South Pole can be distinguished from one another, thus presenting additional educational possibilities.

For example, the rods with a double North Pole can be coloured with cold colours such as purple, blue, green, etc, and the rods with a double South Pole can be coloured with warm colours such as red, orange, yellow, . . . or vice versa, or these rods can be distinguished from one another by choosing the primary colours blue, red, yellow on the one hand, and the complementary colours such as green, orange, purple on the other hand.

As a result magnetic constructions can interact statically or dynamically, which further enhances the playing pleasure.

With the intention of better showing the characteristics of the invention, a few preferred embodiments of the construction toy and attachments according to the invention are described hereinafter by way of an example, without any limiting nature, with reference to the accompanying drawings, wherein.

The construction toy according to the invention contains a set of construction elements in the form of a number of rods 1 and a number of balls 2 of the same diameter.

Figure 9:
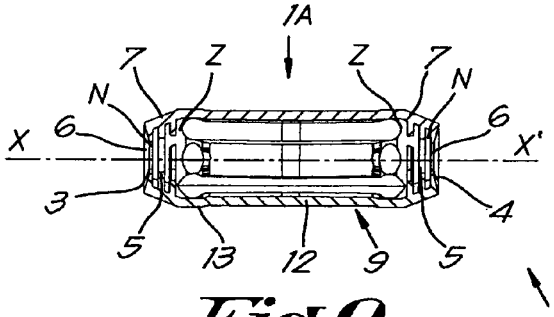

The ends, respectively 3 and 4, of the rods 1 are magnetic, for example by means of magnets 5 and 6 that are fitted into the rod 1, as shown in FIG. 9.

Preferably there is a magnet 5 in each of the ends 3 and 4, each with a North Pole and a South Pole, whereby the magnets are oriented with their N-S axis along the longitudinal axis X-X' of the rod concerned, whereby the magnets, in a preferred embodiment, both have their North Pole or both have their South Pole facing outwards.

Figure 8:
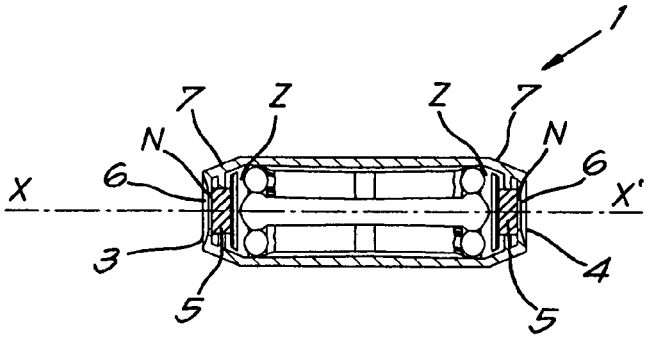
FIGS. 8 and 9 show a cross-section respectively according to line VIII-VIII and according to line IX-IX of FIG. 7.

In the example of FIG. 8 both the magnets have their North Pole facing outwards.

The balls 2 are manufactured from metal that can interact magnetically with the magnetic ends 3-4 of the rods 1.

The balls can be hollow or solid and can have a coating of plastic or similar.

Preferably the balls have a diameter D of at least 45 mm such that they are not dangerous to children under the age of 36 months.

Figure 1:
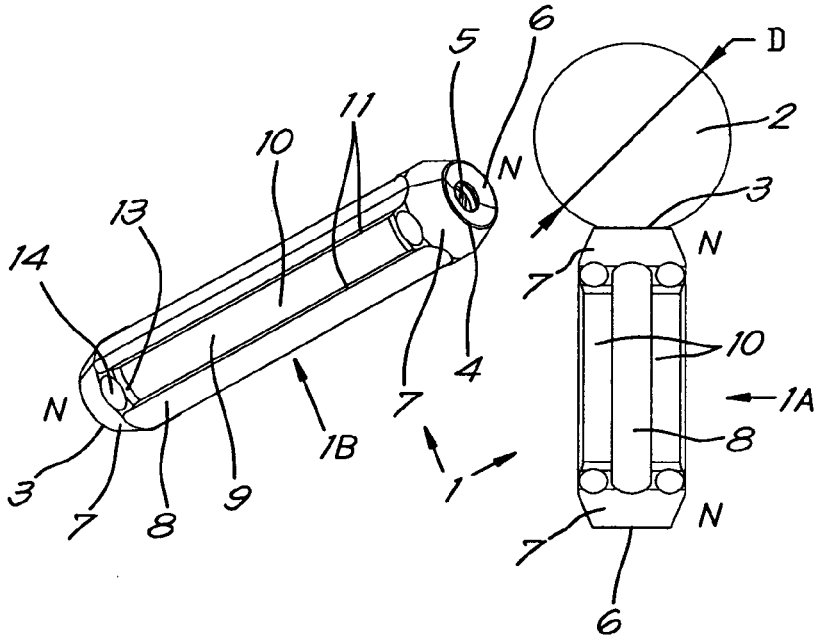
FIG. 1 shows a few construction elements of a construction toy according to the invention.
Figure 2:
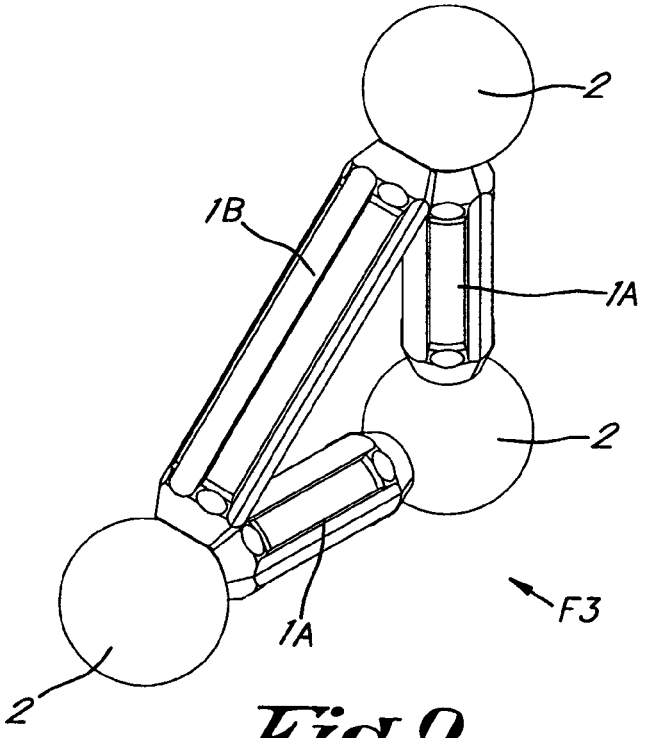
FIG. 2 shows an example of a construction with construction elements, as shown in FIG. 1.
Figure 3:
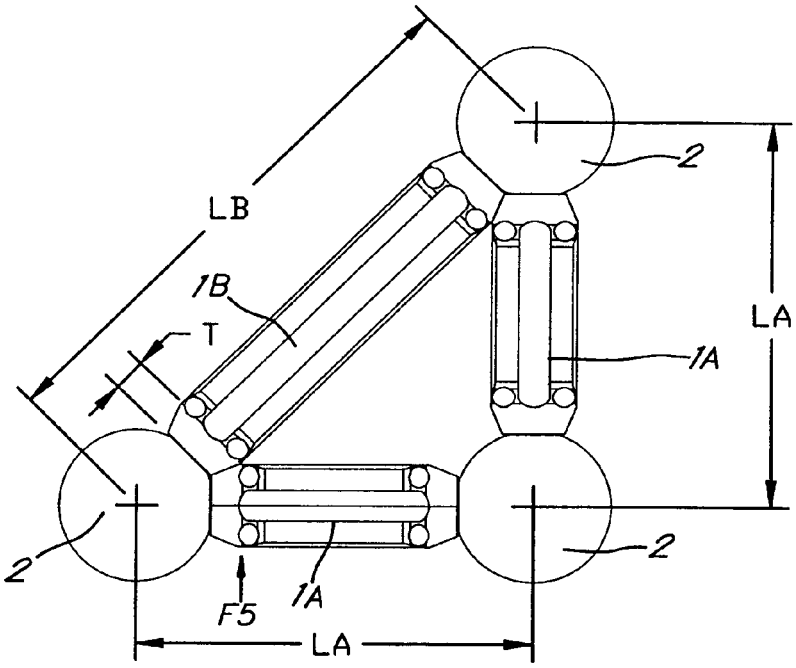
FIG. 3 shows a view according to arrow F3 of FIG. 2.

The rods 1 and balls 2 enable a triangular construction to be built, as shown in FIGS. 2 and 3.

Preferably the rods 1 consist of at least two types of straight rods 1 that primarily differ from one another with regard to form through their length, respectively a short rod 1A and a long rod 1B, whose length is chosen such that the ratio of the distance LB between the centres of two balls 2 coupled to the ends 3-4 of the long rod 1B to the distance LA between the centres of two balls coupled to the ends of the short rod 1A is equal to the square root of two or only differs from it slightly.

Preferably the long rod 1B has magnets that exert a stronger magnetic force than those of the short rod 1A.

In such a case the construction of FIGS. 2 and 3 forms an isosceles right-angled triangle in which the long rod 1B forms a part of the inclined side or hypotenuse.

Such a form turns out to be very useful in constructional practice and such a form also enables the laws of structural mechanics to be explored in a playful way.

In the same way four short rods can be connected together in a flat square by 4 aforementioned balls, whereby the square can be structurally strengthened by using a long rod as a diagonal reinforcement between two balls located at diagonally opposite corners of the square.

The magnetic ends 3-4 of the rods 1 have a spherical depression 6 that extends transversely on the longitudinal axis X-X' of the rod 1 concerned and whose radius of curvature is the same as that of the balls 2 or only differs slightly from it.

As a result, the spherically concave ends 6 of the rods 1 fit closely to the circumference of the balls 2, which fosters the stability of the construction.

The ends of the rods 1 are constructed with a tapered part 7 that narrows towards the ends 3 and 4 over a certain length T, whereby these tapered parts 7 extend to the spherical depression and whereby the outer surface of each tapered part 7 is perpendicular to the surface of the spherical depression 6 at that part 7.

Figure 4:
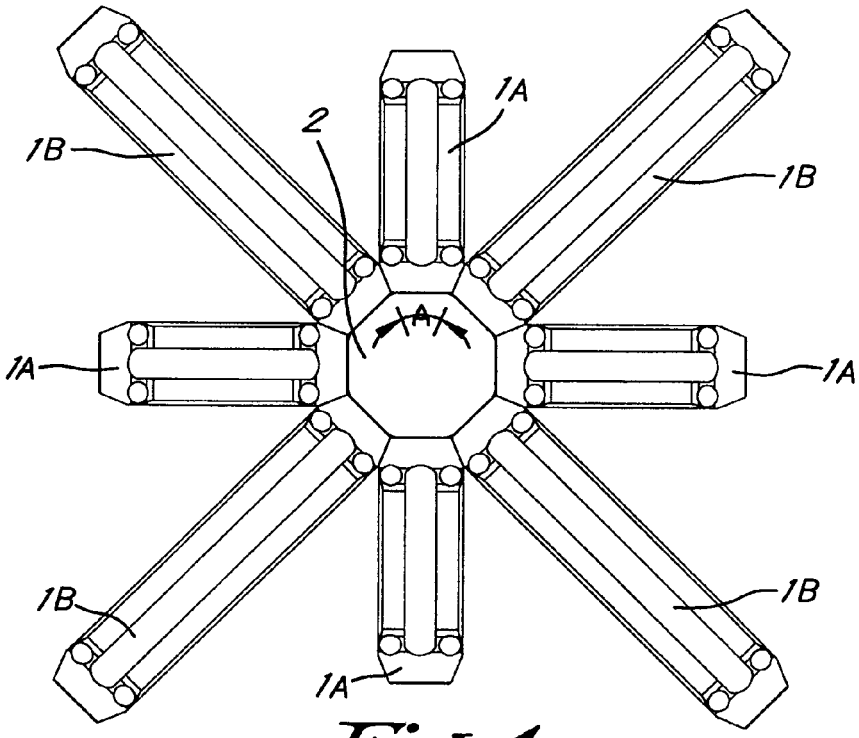
FIG. 4 shows another example of a construction with the construction elements of FIG. 1.
Figure 5:
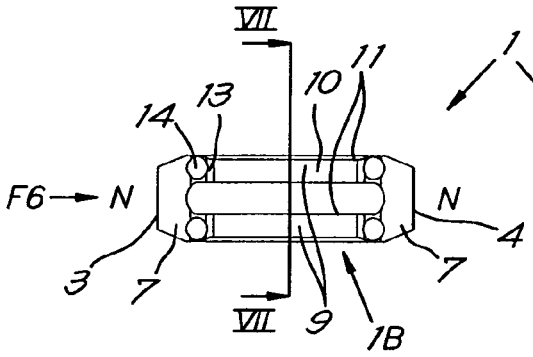
FIG. 5 shows the construction element, on a larger scale, that is shown in FIG. 3 by F5.
Figure 6:
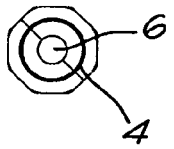
FIG. 6 shows a view according to arrow F6 of FIG. 5.

The tapered angle A enclosed by the tapered parts 7 is preferably 45°, whereby, as shown in FIG. 4, precisely eight rods 2 fit next to one another in a plane of symmetry of a ball 2 whose tapered parts 7 fit closely next to one another, which brings about extra stability in such a case.

Figure 7:
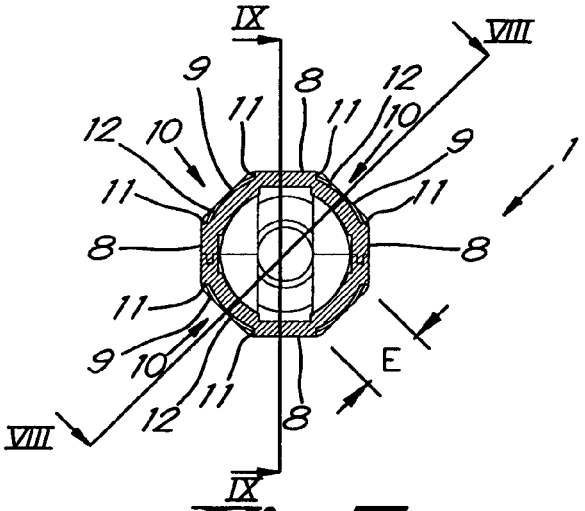
FIG. 7 shows a cross-section according to line VII-VII of FIG. 5.

The rods primarily have an octagonal cross-section, as shown in FIG. 7, with four diametrically opposite flat sides 8 that are connected together by the other four diametrically opposite sides 9 that are slightly hollowed to form grooves 10 that extend along the longitudinal axis X-X' and to form longitudinal upright edges 11 that border the grooves 10.

In the examples shown, the grooves 10 extend over the entire or practically entire width E of the sides 9.

In the example shown, the base 12 of the grooves 10 is constructed as a round sunken cylindrical surface, but other embodiments are not inconceivable.

The opposite edges 11 extend from a side 8, slanting inwards and towards the base 12 of the groove 10 concerned. In the examples shown, the edges 11 are perpendicular to the flat sides 8.

The grooves 10 extend over almost the entire distance between the tapered parts 7, whereby the ends of the grooves 10, via a slanting side 13, lead obliquely towards the outside to a flat part 14 that forms a link between the tapered part 7 and the slanting side 13.

The construction toy, in addition to the construction elements in the form of rods 1 and balls 2, has additional construction elements in the form of attachments 15 that can be securely affixed to the aforementioned rods 1 by snapping them in place.

Figure 10:
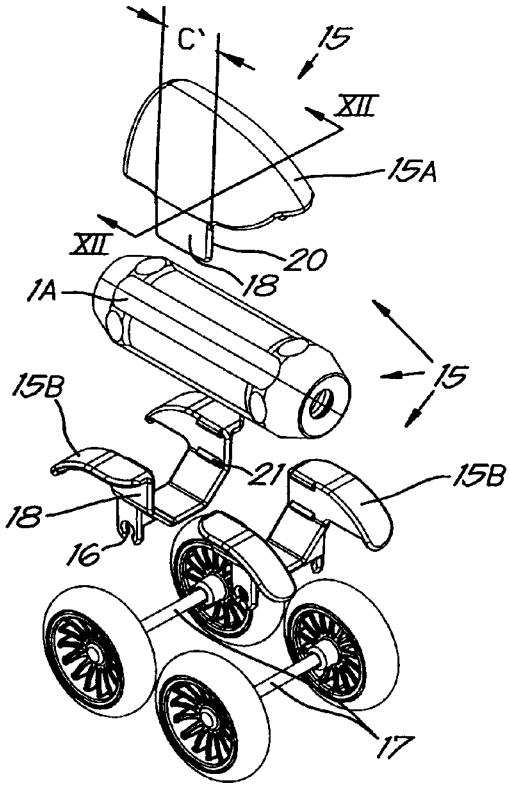
FIG. 10 shows additional construction elements of a construction toy according to the invention.

An example of such attachments 15 is shown in FIG. 10, for example in the form of a cabin 15A and mudguards 15B that are provided with notches 16 for affixing wheel axles 17.

Figure 11:
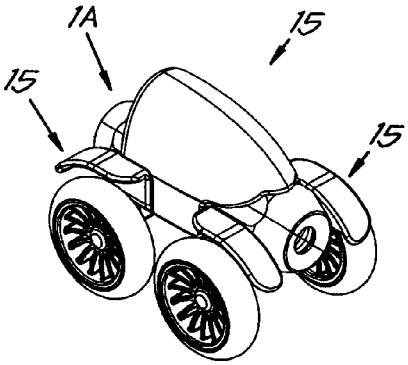
FIG. 11 shows a construction built with the construction elements of FIG. 10.
Figure 12:
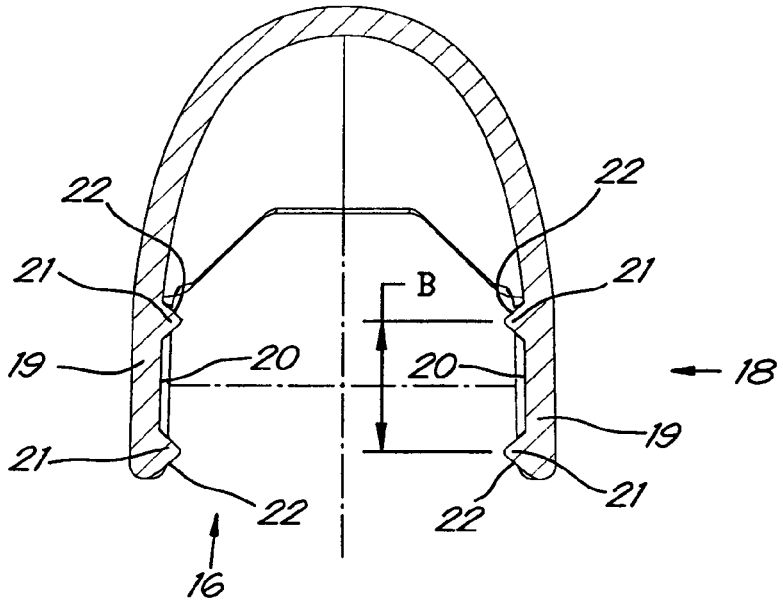
FIGS. 12 and 13 show cross-sections according to line XII-XII of FIG. 10.

With such additional attachments 15 a car according to FIG. 11 can be built.

Figure 13:
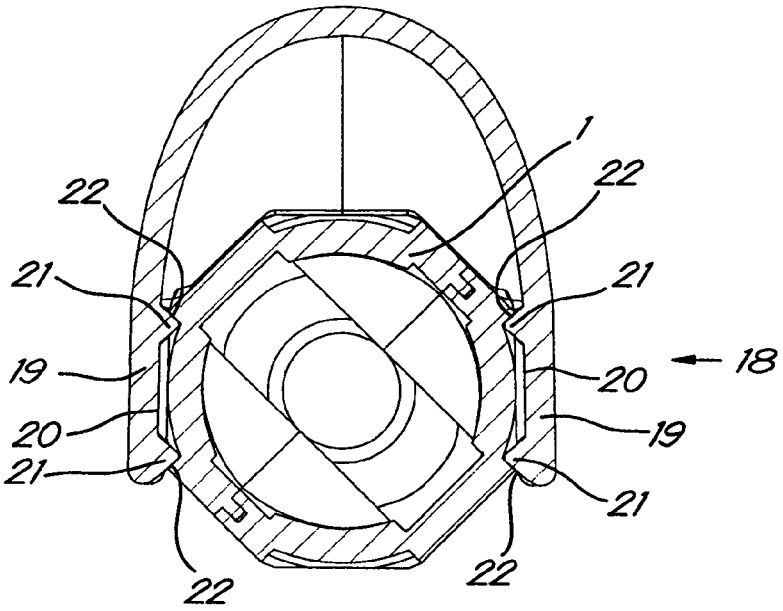

To this end each attachment 15 has a fastening clip 18 with two parallel arms 19 of elastic material that can be affixed transversely over a rod 1 to be secured on the rod 1, and which are provided with inward-oriented ribs 21 on the sides 20 facing one another of the arms 19, with which the fastening clip 18 can be snapped onto the rod 1, as shown in the cross-section of FIG. 13, whereby more specifically the ribs 21 snap into the grooves 10, in particular behind the edges 11.

The arms 19 of the fastening clip 18 preferably have two parallel ribs 21 that are located at a distance B from each other such that they snap in place in pairs between the edges 11 of one hollowed side 9. Preferably to this end the ribs have a bevelled edge 22 with the same angle of incline as the edges 11, and the ribs have a tooth-shaped triangular cross-section.

The fact that the grooves 10 of the hollowed sides are diametrically opposite one another enables each attachment 15 to be affixed to a rod 1 according to four different fixed orientations, i.e. four fixed positions, each time turned by a quarter turn. In practice this turns out to be very useful to make all kinds of constructions, rigs and thematic objects.

According to an alternative embodiment the eight sides 8-9 can be provided with a groove 10, whereby an attachment 15 can be affixed to a rod 1 in eight different positions, each time turned by an eighth of a turn.

The internal shape of the clip 18 between the arms 19 is preferably made such that this shape fits the periphery of the rod 1 when the attachment is snapped in place on the rod 1.

The width C of the arms 19 of a fastening clip 18 is less than the length of the rods 1, all such that a number of attachments 15, preferably three or more attachments 15, can be snapped in place on the same rod 1.

In FIGS. 10 and 11 there are three attachments 15 that are mounted next one another on a short rod 1A.

Figure 14:
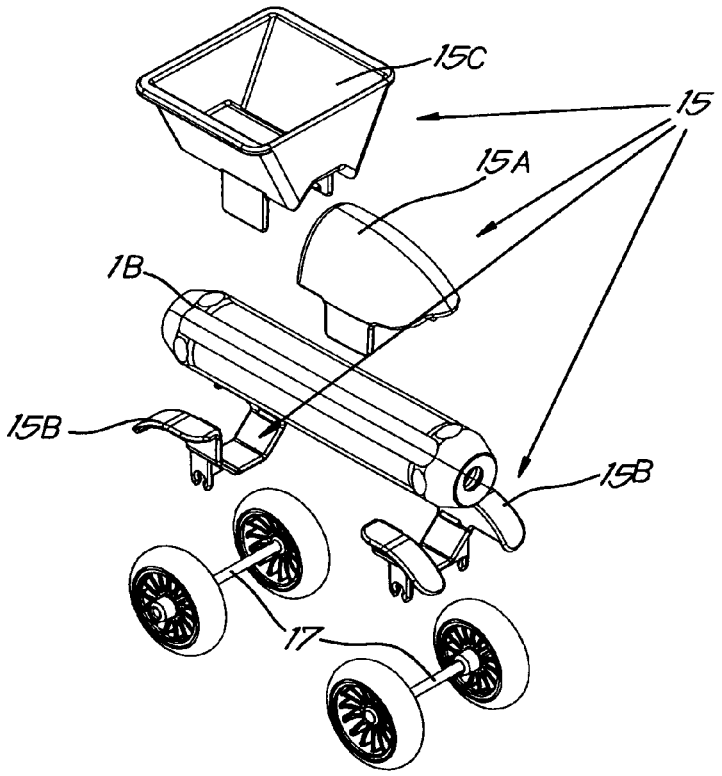
FIGS. 14 and 15 show views such as those of FIGS. 10 and 11, but for a variant construction.
Figure 15:
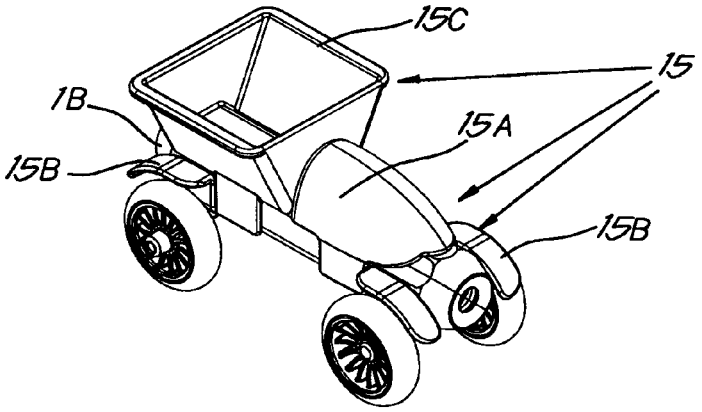

FIGS. 14 and 15 show a variant construction where in this case four attachments 15 are affixed next to each other on a long rod 1B, and whereby, with respect to the embodiment of the car of FIGS. 10 and 11, there is a supplementary container 15C to form a lorry.

Figure 16:
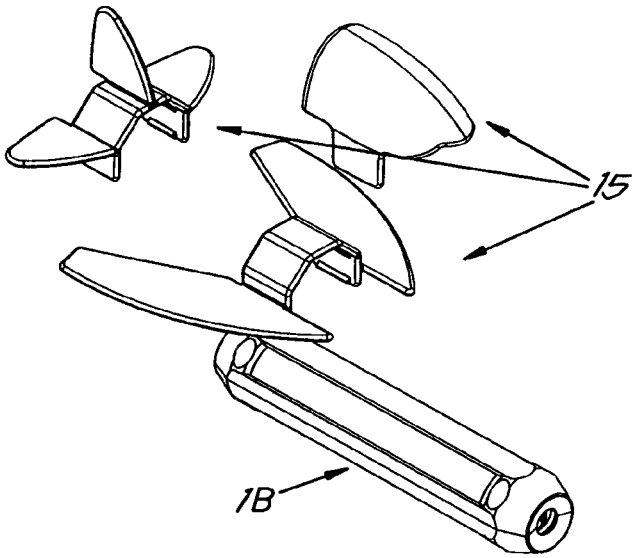
FIGS. 16, 17 and 18 and 19 show other variants of a construction with a construction toy according to the invention.
Figure 17:
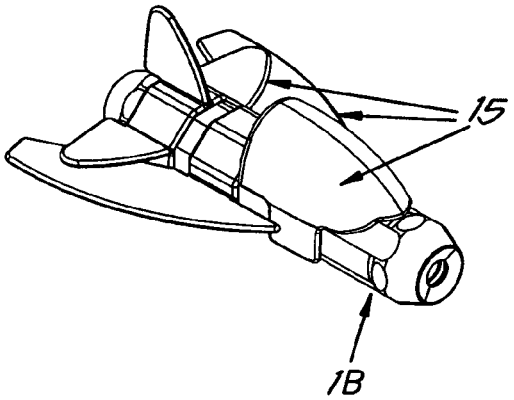
Figure 18:
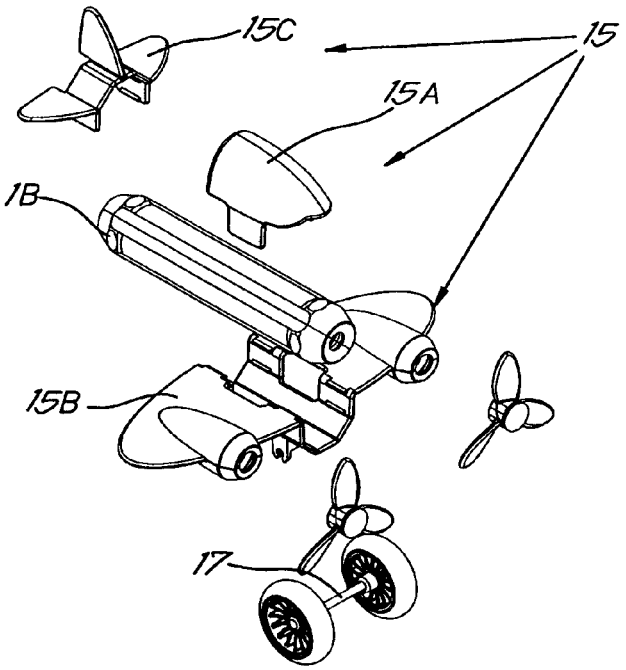
Figure 19:
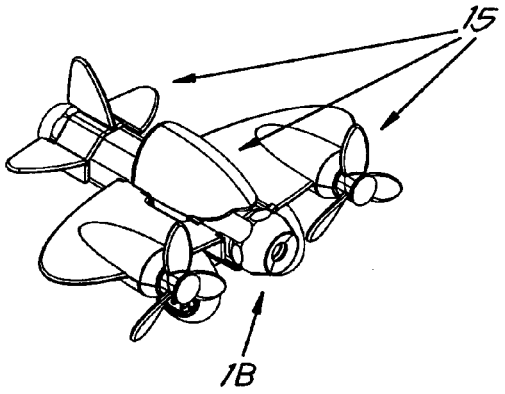

FIGS. 16 and 17 show a variant of a construction toy for building an aircraft, while FIG. 18 shows a variant for a different aircraft.

It is clear that the possibilities are endless.

It is also clear that the attachments 15 can be affixed to a rod 1 in a very simple way by snapping the attachments 15 in place on the rod 1.

In order to remove an attachment 15 from a rod 1, the attachment 15 can be snapped out of the rod 1 by pulling the two parts from one another.

Another way to remove the attachment 15 from the rod 1 is to slide the attachment 15 in the axial direction X-X' on the rod 1, whereby the ribs 21 come up against the slanting sides 13 in the grooves, and with a further axial movement the arms 19 are pushed away from one another by the slanting sides 13, and the ribs 21 are pushed out of the grooves 10. Thus with a minimum of force, the construction can again be taken apart.

The fact that the magnets 5 at the ends 3-4 have the same North or South Pole facing outwards is not necessary but preferred according to the invention.

Figure 20:
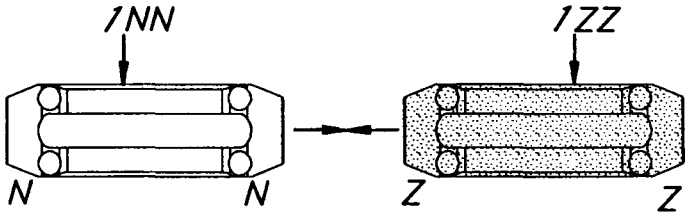
FIGS. 20, 21 and 22 show the magnetic interaction between certain construction elements of the invention.
Figure 21:
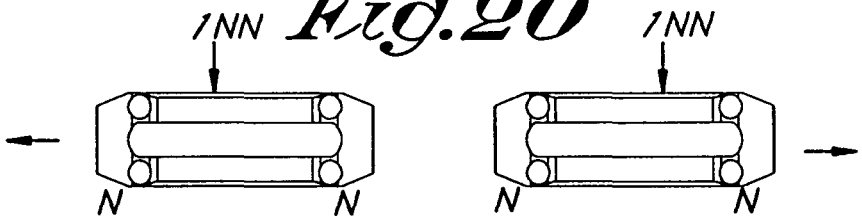
Figure 22:
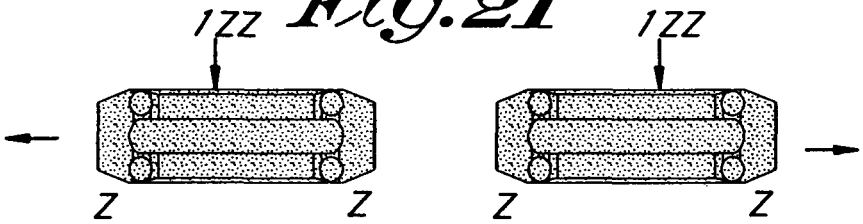
Figure 23:
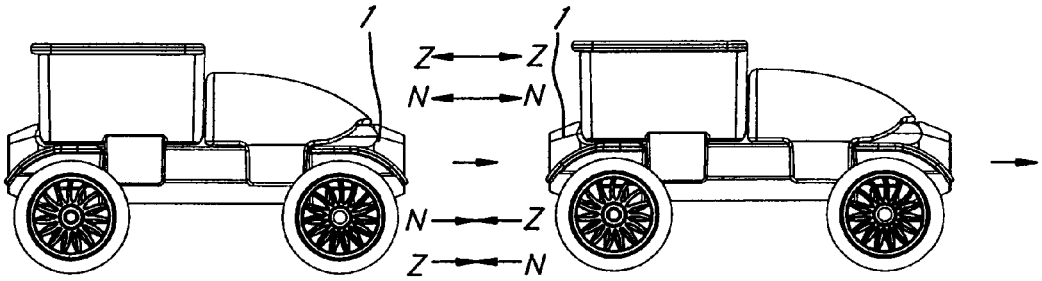
FIG. 23 shows the interaction between constructions built with construction elements according to the invention.

In such a case another aspect of the invention is that the rods 1NN have a double North Pole, i.e. with a North Pole facing outwards at each end 3-4 and other rods 1ZZ have a double South Pole, i.e. with a South Pole "facing outwards" at each end 3-4, as shown in FIGS. 20, 21 and 22.

It is clear that the ends of a rod 1NN and a rod 1ZZ attract one another, as indicated by the arrows in FIG. 20, while two 1NN rods repel one another, as shown in FIG. 21, and two 1ZZ rods also repel one another, as shown in FIG. 22.

By giving the 1NN rods and the "1ZZ" rods a different appearance, for example by using cold colours such as purple, blue, green, . . . for the 1NN rods, and warm colours such as red, orange, green, . . . for the 1ZZ rods, or by using primary colours blue, yellow and red for the 1NN rods, and complementary colours green, orange and purple for the 1ZZ rods, a child can explore and discover the magical properties and natural laws of magnetism in a highly intuitive and educational way.

In this way a child will learn that two cars built from rods 1 of warm colours or two cars built from rods 1 of cold colours repel one another, and consequently that one car can be pushed forward with another car, without them touching one another.

In the same way the child will learn that, depending on the rods 1 used, one car can push another car forward, even without physical contact.

Figure 24:
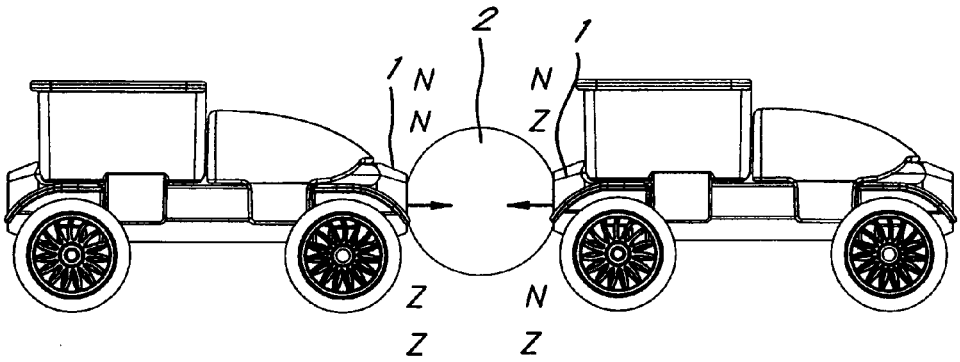
FIG. 24 shows the interaction between almost identical constructions such as in FIG. 23, but with the intervention of an additional construction element in the form of a ball.

The child will also be able to learn that two cars, irrespective of the rods 1 used, can always be coupled by means of a ball 2, as illustrated in FIG. 24, and that consequently such a ball 2 can be used as a type of neutral construction element that can interact with both a South Pole and a North Pole.

The present invention is by no means limited to the embodiments described as an example and shown in the drawings, but a construction toy according to the invention can be realised in all kinds of variants, without departing from the scope of the invention.

The invention claimed is:

1. A Construction toy comprising a set of construction elements, the construction toy comprising:

a number of rods with magnetic ends, the rods having a longitudinal axis a primarily octagonal cross-section wherein the eight sides consist of four first sides and four second sides, the first sides and the second sides in an alternating arrangement, wherein the second sides each have two grooves extending parallel to the longitudinal axis and each groove adjacent one of the first sides, and a number of balls comprising a material that can interact magnetically with the ends of the rods;

one or more preformed attachments, whereby the preformed attachments are each provided with a fastening clip, whereby the fastening clip has two opposing arms which extend primarily parallel to each other, wherein the arms are elastically deformable, wherein each arm has at least one rib, wherein the ribs are positioned on the sides of the arms facing the other arm;

wherein the fastening clip is configured to be clipped onto opposing second sides of said rods, wherein, in a clipped state, the arms straddle one of said rods, with the ribs of the arms each being placed in said grooves; and wherein each magnetic end comprises an inner spherical depression surrounded by an outer tapered surface forming a bevel, the bevel extending from the spherical depression to the first sides and the second sides.

2. The construction toy according to claim 1, wherein said grooves are each bordered by two longitudinal edges, and wherein facing sides of the arms are each provided with a rib, the ribs being parallel and disposed at such a distance from one another that they are configured to snap in place between said longitudinal edges of corresponding grooves.

3. The construction toy according to claim 2, wherein said grooves and their longitudinal edges are formed by depressions in said second sides.

4. The construction toy according to claim 1, wherein the grooves extend over the entire width of said second sides.

5. The construction toy according to claim 1, wherein the base of each of said grooves is shaped as a cylindrical surface.

6. The construction toy according to claim 1, wherein the opposite longitudinal edges of each groove extend from a first side and slope inwards towards the base of the groove.

7. The construction toy according to claim 2, wherein said ribs have a beveled edge with the same angle of incline as said longitudinal edges.

8. The construction toy according to claim 1, wherein the rods have bevel extending a certain length, whereby the bevel is narrowing toward the ends of each rod.

9. The construction toy according to claim 1, wherein the tapered surface is perpendicular to a surface of the spherical depression.

10. The construction toy according to claim 7, characterized in that said angle of incline is 45°.

11. The construction toy according to claim 1, wherein the rods comprise at least two types of rods, a first type of which both ends have a magnetic north pole and a second type of which both ends have a magnetic south pole, wherein the rods of the first type and the rods of the second type distinguishable by the external characteristic of cold colors (green, blue, purple) for the one and warm colors (red, orange, yellow) for the other, or of primary colors (blue, red, yellow) for the one and complementary colors (orange, green, purple) for the other.

12. The construction toy according to claim 1, wherein the first sides of the rods are substantially smooth.

* * * * *